US006779810B1

(12) United States Patent
Mangold

(10) Patent No.: US 6,779,810 B1
(45) Date of Patent: Aug. 24, 2004

(54) SKI BINDING OR SNOWBOARD BINDING

(75) Inventor: Michael Mangold, Farchant (DE)

(73) Assignee: Marker Deutschland GmbH, Eschenlohe (DE)

( * ) Notice: Subject to any disclaimer, the term of this patent is extended or adjusted under 35 U.S.C. 154(b) by 17 days.

(21) Appl. No.: 09/982,757

(22) Filed: Oct. 18, 2001

(30) Foreign Application Priority Data

Oct. 19, 2000 (DE) ..... 100 52 067

(51) Int. Cl.[7] ..... A63C 9/10; A63C 9/00; A63C 5/00; A63C 1/04; B62B 9/04

(52) U.S. Cl. ..... 280/634; 280/616; 280/613; 280/14.22; 280/607; 280/11.32 A

(58) Field of Search ..... 280/607, 633, 280/634, 627, 611, 613, 617, 616, 618, 11.3, 11.31, 11.32, 11.34, 14.21, 14.22, 14.23, 14.24, 602; 441/70

(56) References Cited

U.S. PATENT DOCUMENTS

| | | | | | |
|---|---|---|---|---|---|
| 25,993 | A | * | 11/1859 | Behr et al. | 280/11.32 |
| 4,856,808 | A | * | 8/1989 | Longoni | 280/617 |
| 4,997,199 | A | * | 3/1991 | Horn | 280/618 |
| 5,344,178 | A | * | 9/1994 | Rohrmoser | 280/617 |
| 5,344,179 | A | * | 9/1994 | Fritschi et al. | 280/618 |
| 5,575,496 | A | * | 11/1996 | Luitz et al. | 280/618 |
| 5,813,688 | A | * | 9/1998 | Dacklin | 280/607 |
| 5,947,508 | A | * | 9/1999 | Graf et al. | 280/616 |
| 6,267,403 | B1 | * | 7/2001 | Bossin et al. | 280/625 |
| 6,575,490 | B1 | * | 6/2003 | Laughlin | 280/618 |

FOREIGN PATENT DOCUMENTS

| | | |
|---|---|---|
| DE | 91 17 298 U 1 | 5/2000 |
| WO | WO 95/05219 | 2/1995 |

* cited by examiner

*Primary Examiner*—Brian L. Johnson
*Assistant Examiner*—Gerald B. Klebe
(74) *Attorney, Agent, or Firm*—D. Peter Hochberg; Sean Mellino; Katherine R. Vieyra

(57) ABSTRACT

A ski binding or a snowboard binding having boot holder components on the front end or the toe end and on the rear end or the heel end. The invention includes a holding device which is arranged between the boot holder components and this holding device connects said boot holder components by means of connection elements. These connection elements have an adjusting device having an adjusting input which can be operated by a motor-driven tool, and the connection elements are adjustable against a self-locking effect, that is, adjustable to provide some resistance to further toe-to-heel movement of the connection elements once adjusted. The connection elements can be part of a threaded spindle. The boot holder components and holding device are secured displaceably on the ski or the snowboard in a fixed manner in the vertical direction with a form-fitting connection on a guide rail extending in the longitudinal direction of the ski or snowboard.

7 Claims, 3 Drawing Sheets

SKI BINDING OR SNOWBOARD BINDING

BACKGROUND OF THE INVENTION

1. Field of the Invention

This invention relates to a ski binding or a snowboard binding having boot holder components on the front end or the toe end and on the rear end or the heel end, being arranged on a rail guide on the ski end or on the snowboard end, extending in the longitudinal direction of the ski or snowboard.

2. Description of the Prior Art

A corresponding ski binding is known from German Utility Model 91 17 298 U1. According to this publication, separate guide rail plates are arranged on the ski for the boot holder component on the toe end and on the heel end, with the above-mentioned components being guided displacebly in these guide rail plates in the longitudinal direction of the ski. The boot holder components are connected by means of toothed rods to a pinion which is accommodated in a housing arranged between the two guide rail plates and which engages with the two toothed rods in such a way that the boot holder components are moved toward or away from one another, depending on the direction of rotation, as the pinion is rotated. The set positions of the boot holder components are locked by means of a lock for the pinion or a locking device by means of which at least one boot holder component can be locked on the respective guide rail plate.

The gearbox having the pinion is arranged so that it is movable vertically such that the toothed rods can be lifted up from the top side of the ski in the area of the pinion in the case of flexing movements of the ski.

International Patent WO 95/05219 discloses a snowboard whose supporting structure has two countersunk guide rail pairs integrated into it. Two sliding blocks, each of which has a borehole with an internal screw thread to receive fastening screws of snowboard bindings, are guided displaceably but unrotatably in each guide rail. When the fastening screws are screwed into the threaded boreholes with a significant torque, the sliding blocks and thus the snowboard bindings are fixedly secured on the snowboard or in the guide rails. The guide rails offer the possibility of practically infinitely variable positioning of the bindings on the snowboard.

As a rule, however, bindings on skis and snowboards are secured directly with fastening screws that have previously been screwed into boreholes provided in predetermined positions on the ski or snowboard.

SUMMARY OF THE INVENTION

The object of this invention is to permit rigging of ski bindings and snowboard bindings mostly without the use of tools and to permit the lowest possible burden on the ski or snowboard due to the binding.

This object is achieved according to this invention by a ski binding or a snowboard binding having boot holder components on the front end or the toe end and on the rear end or the heel end. The boot holder components can be displacable and secured vertically in a fixed manner on the ski with a form-fitting connection on a rail guide. The rail guide extends in the longitudinal direction of the ski on top of the ski or the snowboard, said rail guide being integrated into the ski or snowboard and being connected or connectable by means of connection elements in the longitudinal direction of the rail guide on a holder that is or can be secured in a fixed manner on the ski or snowboard between the boot holder components.

This invention is based on the general idea of inserting boot holder components into guide rails which are present on the ski or snowboard and securing said boot holder components by means of a form-fitting connection in the longitudinal direction of the rail guide. The boot holder components are further fixed in the longitudinal direction of the rail guide by means of connection elements that are separate from the ski or snowboard, said connection elements are anchored in a practically fixedly predetermined position on a holding device.

This invention offers the advantage that the ski or snowboard can be designed to withstand high loads in the area of the holding device without having any negative effect on flexibility, and tensile forces occurring between the boot holder components can be largely kept away from the structure of the ski or snowboard.

This offers the advantageous possibility of arranging rail guides with very flexible guide rails, such as single rails, double rails, T-shaped rails or U-shaped rails, in particular even segmented guide rails, which may be desirable from the standpoint of optimum bending behavior of the ski and snowboard.

DESCRIPTION OF THE PREFERRED EMBODIMENTS

According to a first preferred embodiment of this invention, the holding device or a housing of the holding device may be securable in particular on a central section of the rail guide, i.e., the rail guide is also used for the holding device.

Instead of this, it is also possible and advantageous for the holding device or its housing to be integrated at least partially into the ski or snowboard or into the structure of the ski or snowboard.

In addition, this invention also claims protection for a ski binding or a snowboard binding having boot holder components on the front end or the toe end and on the rear end or the heel end. The boot holder components can be connected in the longitudinal direction of the ski by means of connection elements to a holding device which is arranged between the boot holder components, said connection elements being adjustable against a self-locking effect, that is, adjustable to provide some resistance to further toe-to-heel movement of the connection elements once adjusted. The boot holder components and holding device are secured displaceably on the ski or the snowboard in a fixed manner in the vertical direction with a form-fitting connection on a guide rail extending in the longitudinal direction of the ski or snowboard.

This implements the general idea of providing a continuously effective restricted guidance for locking the respective positions set for the boot holder components such that it cannot be eliminated inadvertently or on purpose.

In an especially expedient embodiment, the connection elements are formed by a threaded spindle which is in an axially fixed rotational mount on the holding device and is screwed with a right-handed threaded section into an element with an internal screw thread of the one boot holder component, and a left-handed threaded section is screwed into a corresponding element having an internal screw thread on the other boot holder component, so that with a rotational adjustment of the threaded spindle, the boot holder components are brought either closer together or farther apart from one another. With this arrangement, the two boot holder components are displaced toward one another in opposite directions when the threaded spindle is turned.

Instead of this, it is also possible to provide separate threaded spindles for the two boot holder components. With this design, it is optionally also possible to provide for each threaded spindle to be mounted in an axially fixed manner on the respective boot holder component and screwed into an internal screw thread element on the holding device to permit variation of the distance between the boot holder component and the holding device through a rotational adjustment of the respective spindle.

In all embodiments, the boot holder components may each have a base plate that is displaceable in the respective rail guide and is or can be connected to the holding device by means of the connection element. Then a front or rear boot holding device is mounted on the respective base plate, in which case one of these boot holding devices may be arranged displaceably relative to a base plate against a push-off resiliency which attempts to push this boot holding device in the direction of the other boot holding device. This push-off resiliency guarantees that the boot to be secured will be held in the boot holder components without any play; in addition, in the case of flexing movements of the ski, unwanted twisting between the boot and the boot holder components is prevented.

BRIEF DESCRIPTION OF THE DRAWINGS

Moreover, with regard to preferred features of this invention, reference is made to the claims and the following explanation of the drawings, on the basis of which especially preferred embodiments of this invention are described in greater detail. They show:

DETAILED DESCRIPTION OF THE PREFERRED EMBODIMENTS

Figure 1:
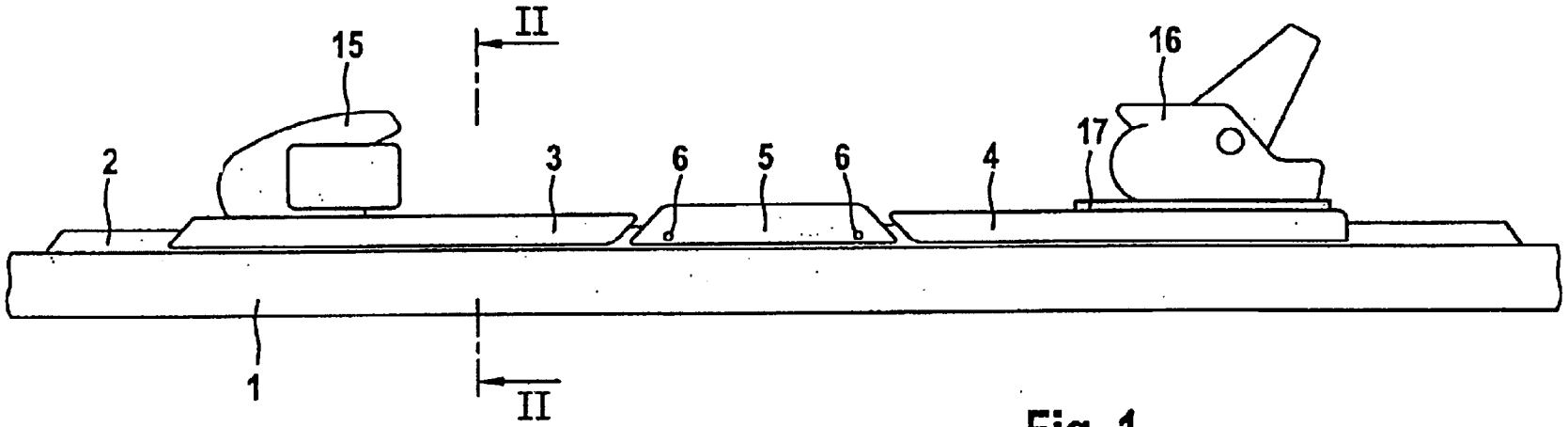
FIG. 1: a schematic side view of a detail drawing of a ski having a ski binding according to this invention.
Figure 2:
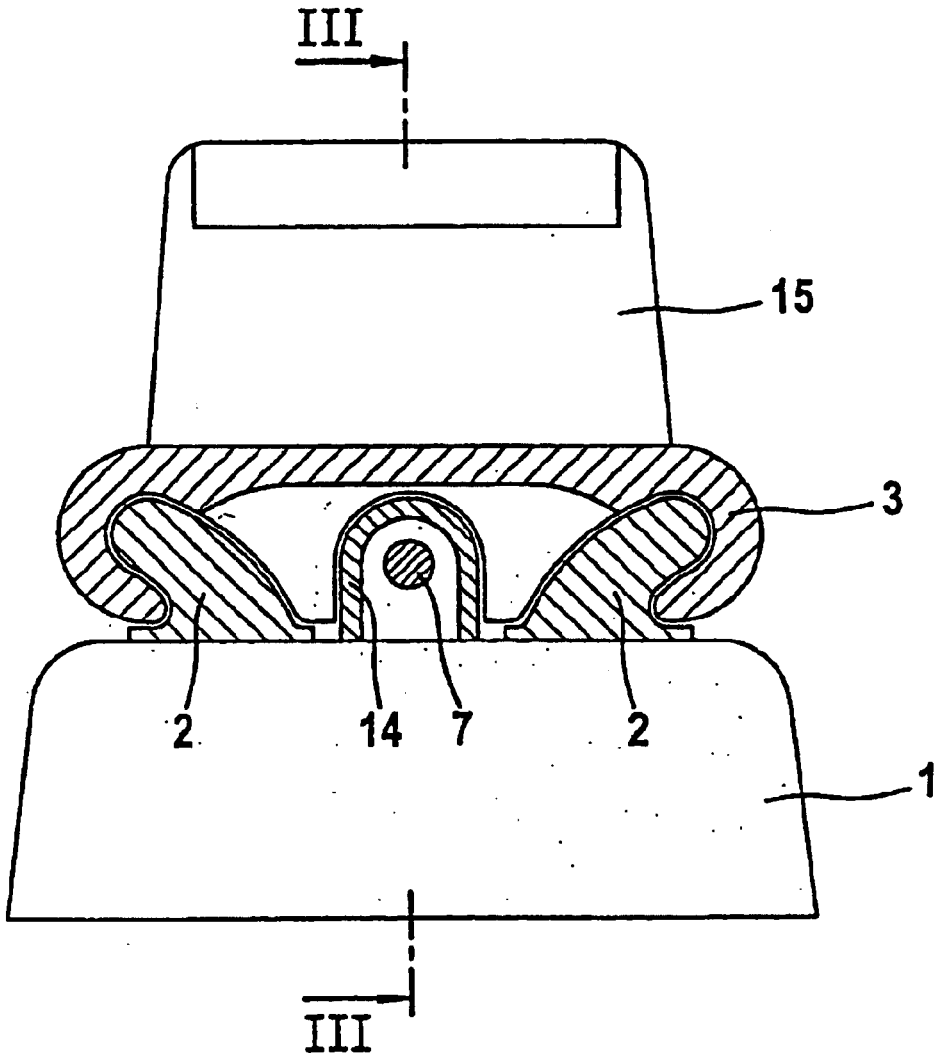
FIG 2: a sectional diagram according to sectional line II—II in FIG. 1, and FIG. 3: a vertical longitudinal section according to sectional line III—III in FIG. 2.

A ski 1, which may basically have a traditional design, has on its top side two rails 2 extending in the longitudinal direction of the ski in the central area of the ski, each rail having profiles symmetrical with the central longitudinal vertical plane of the ski in the example illustrated here in FIG. 2, with edge webs pointing upward and outward obliquely. A front base plate part 3, a rear base plate part 4 and a holding device housing 5 arranged between the base plate parts 3 and 4 are displaceably guided on these rails 2 in the longitudinal direction of the ski, with the holding device housing 5 being undisplaceably secured by splints or pins 6 which are inserted into corresponding, aligned recesses in the holding device housing 5 and rails 2.

A threaded spindle 7 is mounted radially and axially in the holding device housing 5, having a toggle-shaped handle 8 which is accessible through an upper opening in the holding device housing 5 for actuation of its rotational movement. This handle 8 can serve the function of axially undisplaceable mounting of the threaded spindle 7 in interaction with transverse walls of the holding device housing 5 through which the threaded spindle passes.

Threaded spindle 7 has right-handed threaded sections 7' and left-handed threaded sections 7" projecting out of the holding device housing 5 in the longitudinal direction of the ski, said threaded sections being screwed into corresponding nuts 9 and 10, which are in turn arranged in a fixed manner or at least an axially fixed manner inside the base plate parts 3 and 4. The distance between the base plate parts 3 and 4 can he increased or reduced in the longitudinal direction of the skis, depending on the direction of rotation of the threaded spindle 7.

Due to the self-locking design of the threaded sections 7' and 7" of the threaded spindle 7 as well as the nuts 9 and 10 which work together with the threaded spindle, the distance set between the base plate parts 3 and 4 remains unchanged without any special securing measures. However, an additional releasable lock may also be provided. For example, the toggle-shaped handle 8 may also be secured against displacement by means of a catch lever or a lock lever, or it may be secured by the fact that a cover closing the access opening for the handle 8 in the holding device housing 5 also functions as a lock in its closed position.

Figure 3:
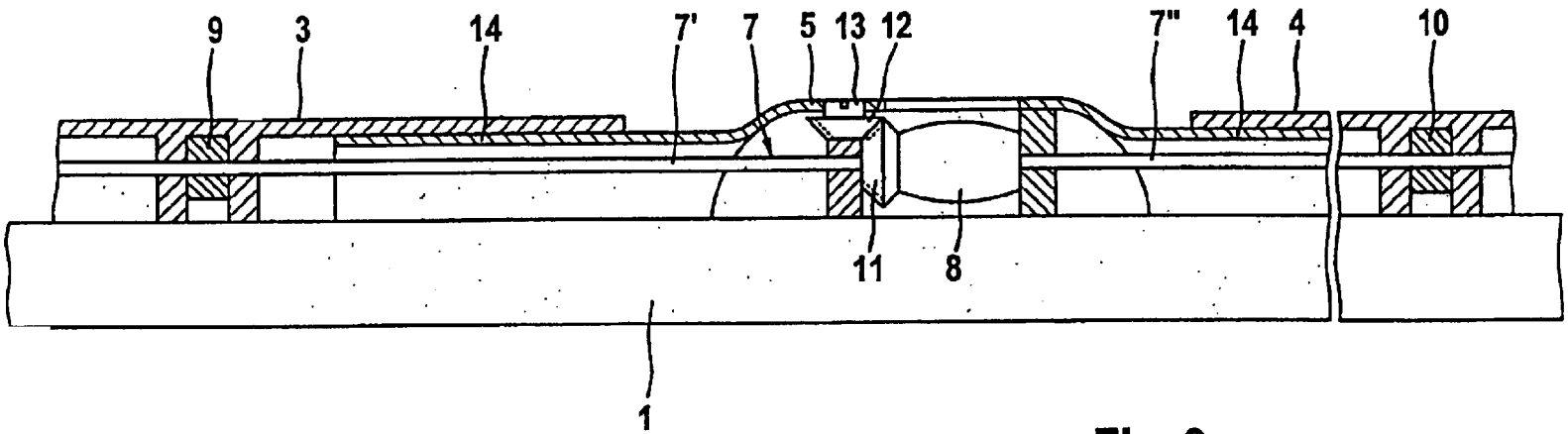

To optionally be able to perform a rapid adjustment of the threaded spindle 7, a conical gearwheel 11 which can be made of the same material, such as plastic, and molded together with or connected to the handle 8 resulting in one piece comprising the gearwheel 11 and handle 8. In another embodiment, the gearwheel can be made of one material, such as metal, and can be integrally molded onto the handle 8 which is made of a different material, such as plastic, as shown in the example of FIG. 3. In both embodiments, the gearwheel and handle can be arranged in a rotationally fixed manner on the threaded spindle 7. This conical gearwheel 11 works together with another conical gearwheel 12 which can rotate about an axis perpendicular to the top side of the ski within the holding device housing 5 and has a projection 13 which is accessible from the top side of the holding device housing 5 in whose upward-turned end face a slot-shaped or out-of-round recess is provided for coupling an electrical screwdriver or the like. In this way the threaded spindle 7 can be turned comparatively rapidly by means of a motor-driven tool (a screwdriver in this case) to produce great changes in position of the base plate parts 3 and 4 accordingly.

To prevent the threaded spindle 7 from being visible or exposed to attack by dirt when the base plate parts 3 and 4 are set at a more or less great distance from the holding device housing 5, projections designed as corresponding covers 14 may be provided on the holding device housing 5. In the example illustrated in FIGS. 2 and 3, these covers 14 are designed as half pipes resting with their open longitudinal side on the top side of the ski. The edge of the base plate parts 3 and 4 facing the holding device housing 5 then has a recess which is adapted to the outside contour of the projections or the half pipes 14, through which recess the covers 14 can be inserted into the interiors of base plate parts 3 and 4.

Base plate parts 3 and 4 serve to arrange boot holding devices 15 and 16 on the toe end and on the heel end, said boot holding devices being arranged on the top side of the base plate parts 3 and 4 by means of corresponding fastening screws. This arrangement corresponds in design essentially to a direct rigging of the boot holding devices 15 and 16 on the top side of the ski.

One of the boot holding devices 15 and 16, usually boot holding device 16 on the heel end, is provided with a longitudinal guide 17 in which the boot holding device 16 can be displaced in a direction leading away from the holding device housing 5 against the force of a push-off resiliency (not shown). This creates in the known way a possibility of holding the ski boot, which is to he secured by means of boot holding devices 15 and 16, without any play. In addition excessive tension on the boot in the boot holding devices 15 and 16 in the case of deflection of the ski is prevented due to the push-off resiliency.

By adjusting the longitudinal distance between the base plate parts 3 and 4, an adjustment to any desired boot sizes can be performed.

In deviation from the embodiment presented here, where the rails 2 are fixedly arranged on the ski 1 or are integrated into its structure, an arrangement in which the rails 2 form parts that can be detached from the ski 1 or are arranged on parts that can be detached from the ski 1 is also possible.

In addition, the holding device housing may also be designed entirely or partially as a part which is fixedly connected to the ski 1 or its structure or is integrated into the structure of the ski 1.

The invention has been described with particular emphasis on the preferred embodiments, but variations and modifications within the spirit and scope of the invention may occur to those skilled in the art to which the invention pertains.

What is claimed is:

1. A ski binding or a snowboard binding having boot holder components on the front or toe end and on the rear or heel end for securing a boot on a ski or a snowboard, the ski or snowboard having a guide apparatus extending in the longitudinal direction of the ski, comprising:

said boot holder components form-fittingly connected to the guide apparatus, said boot holder components fixed on the guide apparatus in the vertical direction and detachable from the guide apparatus in the horizontal direction, a holding device arranged between the boot holder components and secured on the guide apparatus, and connection elements connecting the guide apparatus to the holding device, wherein:

at least one of the boot holder components and the connection elements has an adjusting device having an adjusting input operated by a motor-driven tool.

2. A binding according to claim 1, wherein said motor-driven tool is an electric screwdriver.

3. A ski binding or snowboard binding having boot holder components on the front or toe end and on the rear or heel end for securing a boot on a ski or a snowboard, the ski or snowboard having a guide apparatus extending in the longitudinal direction of the ski, comprising:

said boot holder components form-fittingly connected to the guide apparatus, said boot holder components fixed on the guide apparatus in the vertical direction and detachable from the guide apparatus in the horizontal direction, a holding device arranged between the boot holder components and secured on the guide apparatus, and said boot holder components coupled in the longitudinal direction of the guide apparatus to said holding device, and connection elements adjustable against further toe-to-heel movement of the connection elements connecting the guide apparatus to the holding device, wherein the connection elements are part of a threaded spindle.

4. A binding according to claim 3, wherein the threaded spindle is mounted axially on the holding device and is screwed into parts having an internal screw thread with threaded sections having opposing threads, said parts being arranged in an axially fixed manner in the boot holding components.

5. A binding according to claim 3, wherein at least one of the boot holder components and the connection elements has an adjusting device having an adjusting input operated by a motor-driven tool.

6. A binding according to claim 5, wherein said motor-driven tool is an electric screwdriver.

7. A ski binding or snowboard binding having boot holder components on the front or toe end and on the rear or heel end for securing a boot on a ski or a snowboard, the ski or snowboard having a flexible guide apparatus having a front portion, a central portion and a rear portion, said guide apparatus extending in the longitudinal direction of the ski or snowboard, said binding comprising:

a front base plate for holding a boot holding component and configured for being displaceably mounted on the front portion of said guide apparatus;

a rear base plate configured for being displaceably mounted on the rear portion of said guide apparatus;

a holding apparatus for being fixedly mounted on the central portion of said guide apparatus between said front base plate and said rear base plate; and structure for displacing said front base plate and said rear base plate longitudinally along the guide apparatus;

said front base plate and said rear base plate flexing in response to the flexing of the ski or snowboard when said base plates are mounted on said guide apparatus, wherein said structure for displacing said front base plate and said rear base plate is a rotatable spindle configured to move said base plates in opposite directions according to the direction of rotation of said spindle, and wherein said front base plate and said rear base plate are configured to be moved in the longitudinal direction in response to the rotation of said spindle.

* * * * *